US009713743B1

(12) United States Patent
Friedlander et al.

(10) Patent No.: US 9,713,743 B1
(45) Date of Patent: Jul. 25, 2017

(54) GOLF SWING SENSOR ASSEMBLY

(71) Applicant: Sony Corporation, Tokyo (JP)

(72) Inventors: Steven Friedlander, Escondido, CA (US); David Young, San Diego, CA (US)

(73) Assignee: SONY CORPORATION, Tokyo (JP)

( * ) Notice: Subject to any disclaimer, the term of this patent is extended or adjusted under 35 U.S.C. 154(b) by 22 days.

(21) Appl. No.: 15/004,080

(22) Filed: Jan. 22, 2016

(51) Int. Cl.
*A63B 69/36* (2006.01)
*A63B 24/00* (2006.01)

(52) U.S. Cl.
CPC ..... *A63B 24/0062* (2013.01); *A63B 69/36* (2013.01); *A63B 2208/0204* (2013.01); *A63B 2220/803* (2013.01); *A63B 2220/833* (2013.01)

(58) Field of Classification Search
USPC ..... 473/219, 221, 222, 223, 407, 409
See application file for complete search history.

(56) References Cited

U.S. PATENT DOCUMENTS 5,681,993 A * 10/1997 Heitman ..... A61B 5/225 473/202
8,672,779 B1 * 3/2014 Sakyo ..... A63B 24/0006 473/223
2007/0060425 A1 * 3/2007 Kuenzler ..... A63B 43/00 473/570
2009/0111602 A1 * 4/2009 Savarese ..... A63B 24/0021 473/283
2010/0144455 A1 * 6/2010 Ahern ..... A63B 57/00 473/222
2012/0035003 A1 * 2/2012 Moran ..... A63B 57/00 473/407
2012/0264549 A1 * 10/2012 Homsi ..... A63B 43/008 473/422
2013/0144411 A1 * 6/2013 Savarese ..... G06F 17/40 700/91
2013/0165246 A1 * 6/2013 Jeffery ..... A63B 69/36 473/223
2013/0203518 A1 * 8/2013 Hatton ..... A63B 53/047 473/223
2014/0200093 A1 * 7/2014 Parke ..... G01P 1/023 473/223
2014/0357391 A1 * 12/2014 Parke ..... G01P 1/023 473/221
2015/0335978 A1 * 11/2015 Syed ..... A63B 24/0003 473/223

* cited by examiner

*Primary Examiner* — Nini Legesse
(74) *Attorney, Agent, or Firm* — John L. Rogitz

(57) ABSTRACT

Each club in the bag has a small sensor mount on its shaft with indicia indicating what club (9-iron, 7-iron, fairway 5-wood etc.) the mount is attached to. A swing sensor can then engage the mount and read the indicia, sending both sensed swing information and club type to an app on the golfer's mobile phone. In this way, the app knows not only the swing information but also the type of club that was used to generate that swing information.

18 Claims, 2 Drawing Sheets

GOLF SWING SENSOR ASSEMBLY

TECHNICAL FIELD

The application relates generally to golf swing sensor assemblies.

BACKGROUND

Swing sensors have been provided to measure various swing dynamics, which can be presented to a golfer to help him improve his game.

SUMMARY

As understood herein, it would be advantageous not to force the golfer to inform an analysis application (executing on, e.g., the golfer's mobile phone) which golf club was used to generate the swing data received wirelessly from a swing sensor on the club. As also understood herein, providing respective sensors on each and every club is less than optimum because multiple independent battery-powered sensor assemblies are required.

Accordingly, at least one apparatus includes at least one sensor mount configured for engaging a golf club of a first type. The sensor mount includes indicia indicating the first type. At least one sensor assembly is configured for removably engaging the sensor mount and for detecting the indicia. The sensor assembly includes at least one motion sensor and at least one wireless transceiver for wirelessly sending a signal to a receiver representing motion of the golf club, and the first type.

In examples, the sensor mount defines a channel for closely receiving a shaft of a golf club therein. The sensor mount can be a first sensor mount and the apparatus can include a second sensor mount configured for engaging a golf club of a second type. The second sensor mount can include indicia indicating the second type. The sensor assembly may be configured for removably engaging the second sensor mount and for detecting the indicia of the second sensor mount for wirelessly sending a signal to a receiver representing motion of the golf club, and the second type. Consequently, the sensor assembly can be engaged with the golf club of the first type to transmit swing information and information indicating the first type, removed from the first sensor mount, and engaged with the second sensor mount to transmit swing information and information indicating the second type. Indeed, the apparatus may include respective sensor mounts for each of three or more clubs in a golfer's bag, but can have one and only one sensor assembly.

In some implementations, the sensor mount, which can be made of plastic and/or rubber, contains no energizable components requiring a battery. The sensor assembly may detect the indicia magnetically or physically or using, e.g., near field communication (NFC) such as radiofrequency identification (RFID). The example indicia can includes plural index elements spaced from each other. The index elements can include pins that may lay flat against the sensor mount. The index elements can be registered with index element sensing elements on the sensor assembly.

In another aspect, a method includes sensing motion of a golf club, and also sensing a type of the golf club. The method includes wirelessly transmitting information representing the motion and the type.

In another aspect, a device includes at least one computer memory that is not a transitory signal and that comprises instructions executable by at least one processor to receive at least one wireless transmission from a sensor assembly on a golf club, and present on a display an indication of motion of the golf club, and an indication of a type of the golf club.

This indicia system can also be used for sensors that might be used for different sports. The mount can tell the sensor which sport it should configure for.

The details of the present application, both as to its structure and operation, can best be understood in reference to the accompanying drawings, in which like reference numerals refer to like parts, and in which:

DETAILED DESCRIPTION

Figure 1:
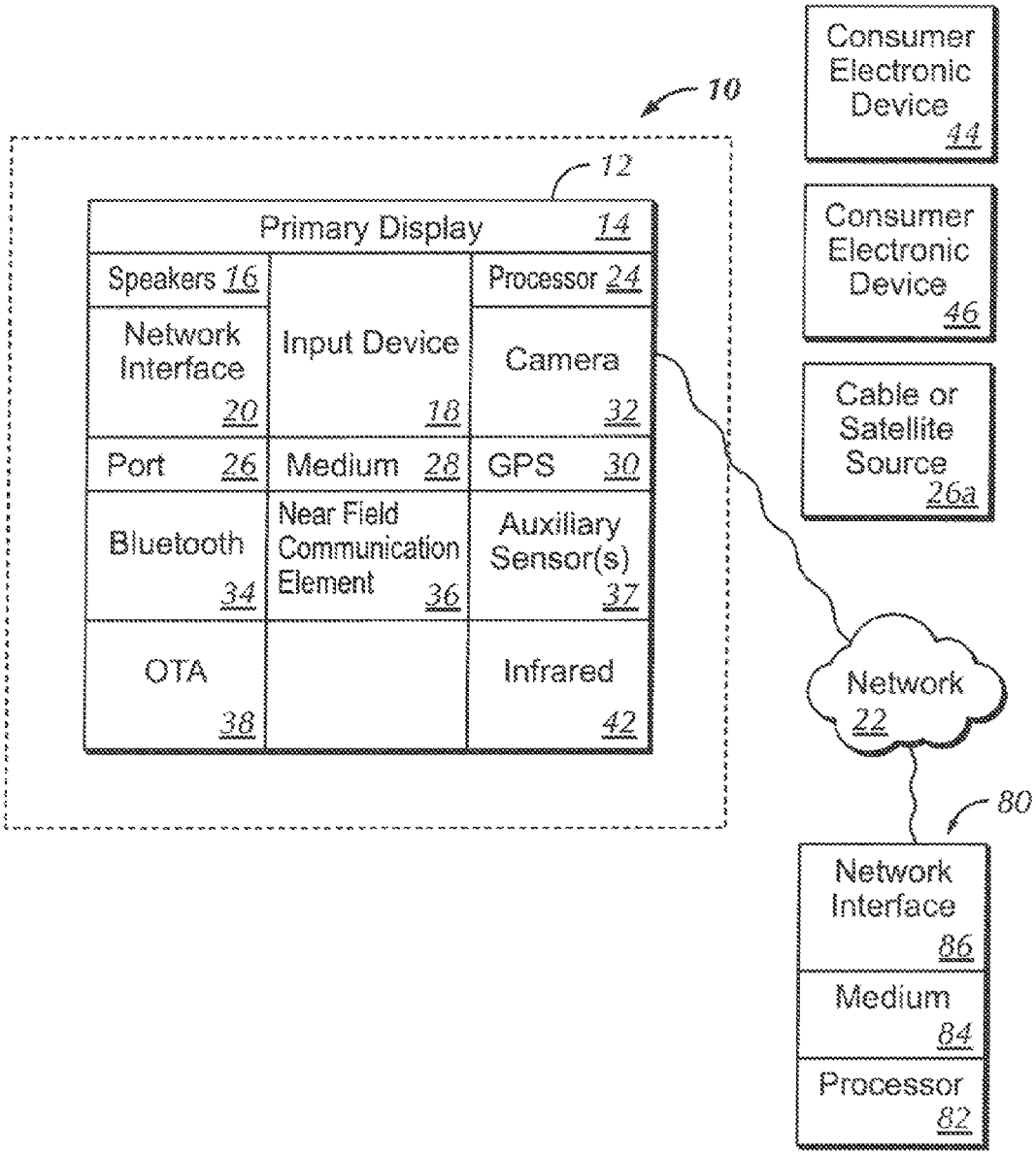
FIG. 1 is a block diagram of an example system including an example in accordance with present principles.

This disclosure relates generally to computer ecosystems including aspects of consumer electronics (CE) device networks. A system herein may include server and client components, connected over a network such that data may be exchanged between the client and server components. The client components may include one or more computing devices including portable wireless golf club swing sensors and wireless phones receiving information from the swing sensors. The client components may also include portable televisions (e.g. smart TVs, Internet-enabled TVs), portable computers such as laptops and tablet computers, and other mobile devices including smart phones and additional examples discussed below. These client devices may operate with a variety of operating environments. For example, some of the client computers may employ, as examples, operating systems from Microsoft, or a Unix operating system, or operating systems produced by Apple Computer or Google. These operating environments may be used to execute one or more browsing programs, such as a browser made by Microsoft or Google or Mozilla or other browser program that can access web applications hosted by the Internet servers discussed below.

Servers and/or gateways may include one or more processors executing instructions that configure the servers to receive and transmit data over a network such as the Internet. Or, a client and server can be connected over a local intranet of a virtual private network. A server or controller may be instantiated by a game console such as a Sony Playstation (trademarked), a personal computer, etc.

Information may be exchanged over a network between the clients and servers. To this end and for security, servers and/or clients can include firewalls, load balancers, temporary storages, and proxies, and other network infrastructure for reliability and security. One or more servers may form an apparatus that implement methods of providing a secure community such as an online social website to network members.

As used herein, instructions refer to computer-implemented steps for processing information in the system. Instructions can be implemented in software, firmware or hardware and include any type of programmed step undertaken by components of the system.

A processor may be any conventional general purpose single- or multi-chip processor that can execute logic by means of various lines such as address lines, data lines, and control lines and registers and shift registers.

Software modules described by way of the flow charts and user interfaces herein can include various sub-routines, procedures, etc. Without limiting the disclosure, logic stated to be executed by a particular module can be redistributed to other software modules and/or combined together in a single module and/or made available in a shareable library, The methods may be implemented as software instructions executed by a processor, including suitably configured application specific integrated circuits (ASIC) or field programmable gate array (FPGA) modules, or any other convenient manner as would be appreciated by those skilled in those art. Where employed, the software instructions may be embodied in a device such as a CD Rom or Flash drive or any of the above non-limiting examples of computer memories that are not transitory signals. The software code instructions may alternatively be embodied in a transitory arrangement such as a radio or optical signal, or via a download over the internet.

Present principles described herein can be implemented as hardware, software, firmware, or combinations thereof; hence, illustrative components, blocks, modules, circuits, and steps are set forth in terms of their functionality.

Further to what has been alluded to above, logical blocks, modules, and circuits described below can be implemented or performed with a general purpose processor, a digital signal processor (DSP), field programmable gate array (FPGA) or other programmable logic device such as an application specific integrated circuit (ASIC), discrete gate or transistor logic, discrete hardware components, or any combination thereof designed to perform the functions described herein. A processor can be implemented by a controller or state machine or a combination of computing devices.

The functions and methods described below, when implemented in software, can be written in an appropriate language such as but not limited to C# or C++, and can be stored on a computer-readable storage medium such as random access memory (RAM), read-only memory (ROM), electrically erasable programmable read-only memory (EEPROM), compact disk read-only memory (CD-ROM) or other optical disk storage such as digital versatile disc (DVD), magnetic disk storage or other magnetic storage devices including removable thumb drives, etc. A connection may establish a computer-readable medium. Such connections can include, as examples, hard-wired cables including fiber optics and coaxial wires and digital subscriber line (DSL) and twisted pair wires.

Components included in one embodiment can be used in other embodiments in any appropriate combination. For example, any of the various components described herein and/or depicted in the Figures may be combined, interchanged or excluded from other embodiments.

"A system having at least one of A, B, and C" (likewise "a system having at least one of A, B, or C" and "a system having at least one of A, B, C") includes systems that have A alone, B alone, C alone, A and B together, A and C together, B and C together, and/or A, B, and C together, etc.

Now specifically referring to FIG. 1, an example ecosystem 10 is shown, which may include one or more of the example devices mentioned above and described further below in accordance with present principles. The first of the example devices included in the system 10 is a consumer electronics (CE) device configured as an example primary display device, and in the embodiment shown is an audio video display device (AVDD) 12 such as but not limited to an Internet-enabled TV with a TV tuner (equivalently, set top box controlling a TV). However, the AVDD 12 alternatively may be an appliance or household item, e.g. computerized Internet enabled refrigerator, washer, or dryer. The AVDD 12 alternatively may also be a computerized Internet enabled ("smart") telephone, a tablet computer, a notebook computer, a wearable computerized device such as e.g. computerized Internet-enabled watch, a computerized Internet-enabled bracelet, other computerized Internet-enabled devices, a computerized Internet-enabled music player, computerized Internet-enabled head phones, a computerized Internet-enabled implantable device such as an implantable skin device, game console, etc. Regardless, it is to be understood that the AVDD 12 may be configured to undertake present principles (e.g. communicate with other CE devices to undertake present principles, execute the logic described herein, and perform any other functions and/or operations described herein).

Accordingly, to undertake such principles the AVDD 12 can be established by some or all of the components shown in FIG. 1. For example, the AVDD 12 can include one or more displays 14 that may be implemented by a high definition or ultra-high definition "4K" or higher flat screen and that may be touch-enabled for receiving user input signals via touches on the display. The AVDD 12 may include one or more speakers 16 for outputting audio in accordance with present principles, and at least one additional input device 18 such as e.g. an audio receiver/microphone for e.g. entering audible commands to the AVDD 12 to control the AVDD 12. The example AVDD 12 may also include one or more network interfaces 20 for communication over at least one network 22 such as the Internet, an WAN, an LAN, etc. under control of one or more processors 24. Thus, the interface 20 may be, without limitation, a Wi-Fi transceiver, which is an example of a wireless computer network interface, such as but not limited to a mesh network transceiver. It is to be understood that the processor 24 controls the AVDD 12 to undertake present principles, including the other elements of the AVDD 12 described herein such as e.g. controlling the display 14 to present images thereon and receiving input therefrom. Furthermore, note the network interface 20 may be, e.g., a wired or wireless modem or router, or other appropriate interface such as, e.g., a wireless telephony transceiver, or Wi-Fi transceiver as mentioned above, etc.

In addition to the foregoing, the AVDD 12 may also include one or more input ports 26 such as, e.g., a high definition multimedia interface (HDMI) port or a USB port to physically connect (e.g. using a wired connection) to another CE device and/or a headphone port to connect headphones to the AVDD 12 for presentation of audio from the AVDD 12 to a user through the headphones. For example, the input port 26 may be connected via wire or wirelessly to a cable or satellite source **26*a* of audio video content, Thus, the source 26*a* may be, e.g., a separate or integrated set top box, or a satellite receiver. Or, the source 26*a*** may be a game console or disk player containing content that might be regarded by a user as a favorite for channel assignation purposes described further below.

The AVDD 12 may further include one or more computer memories 28 such as disk-based or solid state storage that are not transitory signals, in some cases embodied in the chassis of the AVDD as standalone devices or as a personal video recording device (PVR) or video disk player either internal or external to the chassis of the AVDD for playing back AV programs or as removable memory media. Also in some embodiments, the AVDD 12 can include a position or location receiver such as but not limited to a cellphone receiver, GPS receiver and/or altimeter 30 that is configured to e.g. receive geographic position information from at least one satellite or cellphone tower and provide the information to the processor 24 and/or determine an altitude at which the AVDD 12 is disposed in conjunction with the processor 24. However, it is to be understood that that another suitable position receiver other than a cellphone receiver, GPS receiver and/or altimeter may be used in accordance with present principles to e.g. determine the location of the AVDD 12 in e.g. all three dimensions.

Continuing the description of the AVDD 12, in some embodiments the AVDD 12 may include one or more cameras 32 that may be, e.g., a thermal imaging camera, a digital camera such as a webcam and/or a camera integrated into the AVDD 12 and controllable by the processor 24 to gather pictures/images and/or video in accordance with present principles. Also included on the AVDD 12 may be a Bluetooth transceiver 34 and other Near Field Communication (NFC) element 36 for communication with other devices using Bluetooth and/or NFC technology, respectively. An example NFC element can be a radio frequency identification (RFID) element.

Further still, the AVDD 12 may include one or more auxiliary sensors 37 (e.g., a motion sensor such as an accelerometer, gyroscope, cyclometer, or a magnetic sensor, an infrared (IR) sensor, an optical sensor, a speed and/or cadence sensor, a gesture sensor (e.g. for sensing gesture command), etc.) providing input to the processor 24. The AVDD 12 may include an over-the-air TV broadcast port 38 for receiving OTH TV broadcasts providing input to the processor 24. In addition to the foregoing, it is noted that the AVDD 12 may also include an infrared (IR) transmitter and/or IR receiver and/or IR transceiver 42 such as an IR data association (IRDA) device. A battery (not shown) may be provided for powering the AVDD 12.

Still referring to FIG. 1, in addition to the AVDD 12, the system 10 may include one or more other CE device types. When the system 10 is a home network, communication between components may be according to the digital living network alliance (DLNA) protocol.

In one example, a first CE device 44, which may be a golf swing sensor assembly, and second CE device 46, which may be a mobile phone, may each include suitable components such as one or more of the components contained in the AVDD 12. In the example shown, only two CE devices 44, 46 are shown, it being understood that fewer or greater devices may be used.

Now in reference to the afore-mentioned at least one server 80, it includes at least one server processor 82, at least one tangible computer readable storage medium 84 such as disk-based or solid, state storage, and at least one network interface 86 that, under control of the server processor 82, allows for communication with the other devices of FIG. 1 over the network 22, and indeed may facilitate communication between servers and client devices in accordance with present principles. Note that the network interface 86 may be, e.g., a wired or wireless modem or router, Wi-Fi transceiver, or other appropriate interface such as, e.g., a wireless telephony transceiver.

Accordingly, in some embodiments the server 80 may be an Internet server, and may include and perform "cloud" functions such that the devices of the system 10 may access a "cloud" environment via the server 80 in example embodiments. Or, the server 80 may be implemented by a game console or other computer in the same room as the other devices shown in FIG. 1 or nearby.

In the description below, "golf club type" means the generic type of club, e.g., what number iron or wood, and not the manufacturer, for instance. It is to be understood that the indicia on the sensor mount may include, in addition to golf club type, the manufacturer and other information such as left-handed club or right-handed club or ladies club or shaft stiffness, etc.

Figure 2:
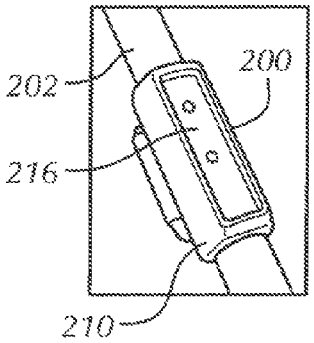
FIGS. 2-7 are perspective views of the sensor assembly engaging the shaft of a golf club, with certain views showing the sensor itself in an exploded relationship with the mount and with portions of the shaft broken away for clarity.
Figure 3:
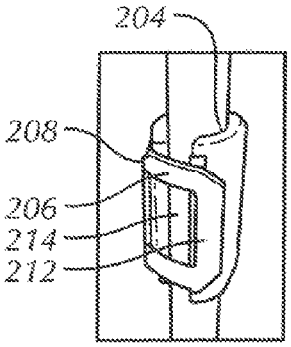

Accordingly, FIGS. 2 and 3 show an example sensor mount 200 made of rubber and/or plastic. The mount may be resilient and if desired slightly deformable to facilitate engaging the mount 200 with a golf club, in the example shown, with the shaft 202 of a golf club.

In the embodiment depicted, the mount 200 is formed with a channel 204 that snugly receives the shaft 202 of the club. If desired, the tackiness of material from which the mount 200 is made and the tight fit with the shaft 202 may be all that is desired to hold the mount 200 onto the shaft 202. In other embodiments, however, and as best shown in FIG. 3, a hinged closure 206 may be provided that is hinged along an edge 208 to the channel portion 210 of the mount 200 and may snappingly engage a clip edge 212 that is opposed to the hinge edge 208 with the channel portion 210, spanning the opening in the channel portion 210 as shown. The hinged closure 206 may be formed if desired with a central opening 214 through which the shaft 202 of the club is visible.

As perhaps best shown in FIG. 2, opposite the hinged closure 206, the outer surface of the channel portion 210 of the sensor mount 200 may be formed with a slightly recessed (from the edges as shown) rectilinear flat receptacle 216. Indicia formed in a size and/or shape and/or pattern and/or number of elements may be formed in the receptacle 216 in a configuration unique to the particular golf type, such that each golf club type is fitted with a sensor mount bearing indicia indicating the type of club.

Figure 4:
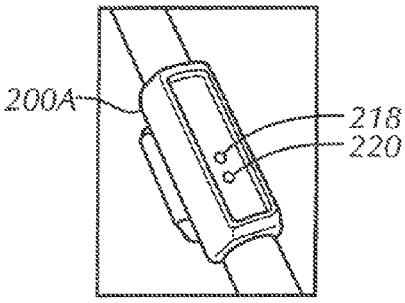
Figure 5:
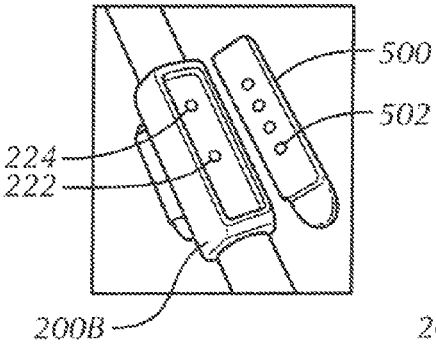

FIGS. 4 and 5 illustrate. In FIG. 4, the type-indicating indicia of a mount 200A includes first and second closely spaced index elements 218, 220. One index element 218 is located near the center of the receptacle and the other index element 220 is located just below (looking down on FIG. 3) the center index element 218. In contrast, in FIG. 5, the type-indicating indicia of a mount 200B includes first and second index elements 222, 224. One index element 222 is located near the center of the receptacle and the other index element 224 is located above (looking down on FIG. 4) the center index element 222. The spacing between the index elements 222, 224 in FIG. 5 is greater than the spacing between the index elements 218, 220 in FIG. 4. Owing to the different spacing, and locations of the index elements in FIG. 4 compared to FIG. 5, the indicia in FIG. 4 may be correlated to, e.g., an 8-iron while the indicia in FIG. 5 can be correlated to e.g., a 3-wood.

It may now be appreciated that various spacings, arrangements, numbers, shapes, sizes, etc. of the index elements can be used to establish within the sensor mount receptacle that is unique to the type of club with which the sensor mount has been engaged. In examples embodiments, four (4) index elements may be used, or only two used with three different possible spacings or relative angles or other distance/location quanta providing for, e.g., up to sixteen (16) unique indications.

In the example shown, the index elements are dot-like circles that in some implementations may lay flush against the surface of the receptacle or may extend slightly about the surface of the receptacle in the configuration of posts or domes. The index elements may be magnetic or ferrous beads or RFID tags implanted in the sensor mount body for being magnetically sensed or sensed by RFID by the sensor described below, or they may be plastic or even made integrally with the sensor mount for physical sensing by the sensor. No energizable components requiring a battery need be included in the sensor mounts shown herein.

Figure 6:
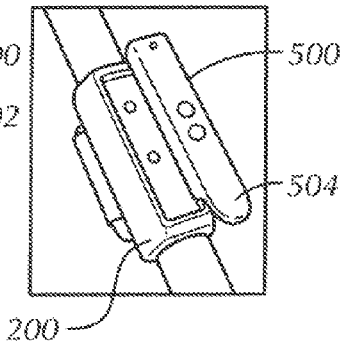
Figure 7:
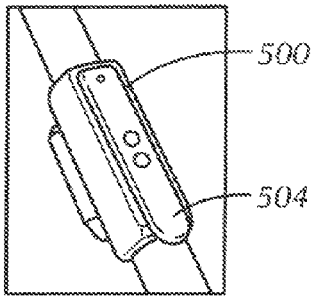

While each one of multiple clubs in the golfer's bag (and indeed, if desired all of the clubs in the golfer's bag) can have respective sensor mounts engaged as described, with each sensor mount hearing indicia unique to the respective club type. FIGS. 5-7 show that only a single sensor assembly 500 need be provided for removable or detachable engagement with the sensor mount of whichever club is being swung. As shown in FIG. 5, the sensor assembly 500, which may include a lightweight hollow plastic or metal housing that is generally parallelepiped-shaped as shown, may be positioned by hand in the receptacle of the sensor mount in an interference snap fit therewith to hold the sensor assembly 500 in the receptacle. On the surface of the sensor assembly 500 that faces the receptacle of the sensor mount, one or more index sensing elements 502 may be arranged. In the example shown, a longitudinal row of sensing elements 502 are arranged on the sensor assembly 500, one sensing element 502 for each possible location of an index element of one of the sensor mounts. By having more sensing elements 502 than any one sensor mount has index elements in the non-limiting example shown, it is assured that every index element of any of the sensor mounts is registered with at least one of the sensing elements 502 of the sensor assembly 500. The sensing elements 502 may be, without limitation, magnetic sensing elements such as Hall effect sensors, or physical contact sensors such chemical or electrical sensors, or RFID readers, or movable detents that are moved when in contact with a corresponding index element of a sensor mount.

According, it may now be appreciated that the sensor assembly 500 can be engaged with the sensor mount of a golf club to be swung. The processor described above that is within the sensor assembly 500 receives the signals from the sensing elements 502 to determine the indicia of the sensor mount with which the assembly is engaged. The club can be swung and the sensor assembly can transmit, through its wireless transmitter, a signal carrying information not only related to the swing as sensed by one of the above-described motion sensors within the sensor assembly, but also an identification of the type of club being swung as determined from the indicia of the sensor mount.

If desired, a handle extension 504 may be formed as part of the sensor assembly 500 and can extend past both the rectilinear portion of the body of the sensor assembly and the sensor mount 200 when the sensor assembly 500 is engaged with the sensor mount 500. The edge of the handle extension 504 may be curved as shown. A golfer can grasp the handle extension 504 and pull it to remove the sensor assembly 500 from the sensor mount 200 of one club and engage the sensor assembly 500 with the sensor mount 200 of another club intended to be swung.

Figure 8:
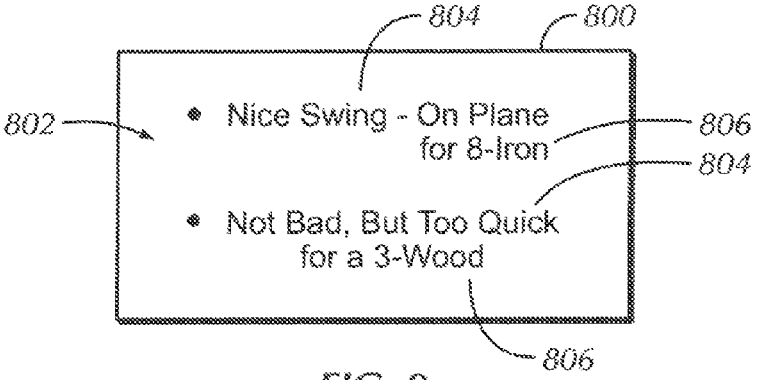
FIG. 8 is a screen shot on a mobile device that may be generated by an example application receiving information from the sensor assembly.

FIG. 8 shows that display 800 of the CE device 46 for example, when configured as the golfer's mobile phone executing a downloadable application that is configured to receive information from the sensor 500, can present a user interface (UI) 802. The UI 802 may present not only swing-related information 804, but also golf club type information 806, based on the information from the sensor assembly 500. It will be appreciated that the information 804, 806 is typically expert-derived, meaning that an expert can correlate the efficacy of particular swing data to particular golf club types, with the correlations being programmed into the app.

It will be appreciated that whilst present principals have been described with reference to some example embodiments, these are not intended to be limiting, and that various alternative arrangements may be used to implement the subject matter claimed herein.

What is claimed is:

1. At least one apparatus comprising:

at least a first sensor mount configured for engaging a golf club of a first type of iron or wood, the first sensor mount including first indicia indicating the first type, the first sensor mount comprising a channel configured to closely receive a golf club shaft within the channel of the first sensor mount, the first sensor mount not containing any energizable components;

at least a second sensor mount configured for engaging a golf club of a second type of iron or wood, the second type being different from the first type, the sensor mount including second indicia indicating the second type, the second indicia being different from the first indicia, the second sensor mount comprising a channel configured to closely receive a golf club shaft within the channel of the second sensor mount, the second sensor mount not containing any energizable components; and at least one sensor assembly including structure configured for removably engaging the first sensor mount and for detecting the first indicia, the sensor assembly including at least one motion sensor and at least one wireless transceiver for wirelessly sending a signal to a receiver representing motion of the golf club of the first type, and the first type, the sensor assembly being disengageable from the first sensor mount and engageable with the second sensor mount on the golf club of the second type for wirelessly sending a signal to the receiver representing motion of the golf club of the second type, and the second type.

2. The apparatus of claim 1, comprising respective sensor mounts for each of three or more clubs in a golfer's bag and one and only one sensor assembly.

3. The apparatus of claim 1, wherein the sensor assembly detects the indicia magnetically.

4. The apparatus of claim 1, wherein the sensor assembly detects the indicia physically.

5. The apparatus of claim 1, wherein the first indicia includes plural index elements spaced from each other.

6. The assembly of claim 5, wherein the index elements include pins.

7. The assembly of claim 5, wherein the index elements are flat against the sensor mount.

8. The apparatus of claim 5, wherein the index elements match index element sensing elements on the sensor assembly.

9. The assembly of claim 1, wherein the first sensor mount is made of rubber and/or plastic.

10. A method comprising:

using a sensor physically engaged with a golf club of a first type, sensing motion of the golf club;

sensing the first type of the golf club;

wirelessly transmitting information representing the motion and the first type;

subsequently using the sensor to physically engage a golf club of a second type;

sensing the second type; and wirelessly transmitting information representing motion of the golf club of the second type, and the second type.

11. The method of claim 10, comprising executing the sensing using a sensor assembly engaged with a sensor mount on the golf club.

12. The method of claim 11, wherein the sensor assembly senses first indicia on the sensor mount.

13. The method of claim 12, comprising facilitating removal of the sensor assembly from the sensor mount and facilitating the engagement of the sensor assembly with a different sensor mount having second indicia different from the first indicia and engaged with a different golf club, and wirelessly transmitting information representing motion and type of the different golf club.

14. An assembly comprising:

a first sensor mount with a channel configured to receive a shaft of a first golf club having a first type, the first sensor mount including first index elements in a first arrangement indicating the first type;

a second sensor mount with a channel configured to receive a shaft of a second golf club having a second type, the second sensor mount including second index elements in a second arrangement indicating the second type, the second type being different from the first type, the second arrangement being different from the first arrangement; and a sensor assembly removably engageable with the first sensor mount to transmit a signal representing motion of the first golf club and the first type, the sensor assembly being disengageable with the first sensor mount and being engageable with the second sensor mount to transmit a signal representing motion of the second golf club and the second type.

15. The assembly of claim 14, wherein the channel of the first sensor mount snugly receives the shaft of the first golf club.

16. The assembly of claim 14, wherein the first sensor mount comprises a hinged closure that is hinged along an edge to the channel of the first sensor mount to snappingly engage a clip edge that is opposed to the edge.

17. The assembly of claim 16, wherein the hinged closure is formed with a central opening through which the shaft of the first golf club is visible.

18. The assembly of claim 17, wherein opposite the hinged closure, an outer surface of channel portion of the first sensor mount is formed with a recessed flat receptacle, the index elements being located in the recessed flat receptacle.

* * * * *